United States Patent [19]

Harrison

[11] 4,000,571

[45] Jan. 4, 1977

[54] SCHEDULING BOARD AND METHOD OF USE THEREOF

[76] Inventor: Jack M. Harrison, 49 W. Malvern Ave., Salt Lake City, Utah 84115

[22] Filed: Mar. 10, 1975

[21] Appl. No.: 556,789

[52] U.S. Cl. ..... 40/19.5; 35/7 R

[51] Int. Cl.[2] ..... G09F 3/18

[58] Field of Search ..... 40/19.5, 124, 124.2; 35/24 A, 7 R

[56] References Cited

UNITED STATES PATENTS 2,965,978 12/1960 Olson ..... 40/19.5 X

FOREIGN PATENTS OR APPLICATIONS 248,951 6/1926 Italy ..... 40/19.5

*Primary Examiner*—Louis G. Mancene
*Assistant Examiner*—John H. Wolff
*Attorney, Agent, or Firm*—B. Deon Criddle

[57] ABSTRACT

A scheduling board having multiple bracket classes identified thereon, with paired sets of attachment means grouped to receive sequentially and numerically identified participant tags and with one or more groups of the attachment means. In practicing the method of the invention, the participant tags are numerically positioned on first group attachment means with one-half of the participant tags being sequentially arranged in a first column and with the remaining one-half of the participant tags being arranged in a second column. The tags in the columns are aligned and the order of ascending numerical sequence of the participant tags in the second column is directionally opposite to the order of ascending numerical sequence of the participant tags in the first column. The horizontally aligned participant tags identify competitors for a round in a competitive event and after the round has been completed the lowest number tag is left in position and the other tags are rotated to move an end tag from the first column directly across to the other column and the tag at the other end of the second column into the first column between the tag at the other end of that column, which is not moved, and the next tag in the column.

All tags other than the one tag that is not moved are maintained in the same rotational order established by the initial placement on the scheduling board. After each rotation of the participant tags the competitors identified by the horizontally aligned tags compete in a round of the competitive event and the tags (all except the end tag of row one which is kept stationary) are moved in the same rotational pattern previously described to establish a new schedule for a round of play. After each round of play the tags are moved according to the same rotational pattern until each pair of tags have been paired to indicate competition by the represented participants. One or more of the participants winning the most rounds may then be moved to a higher bracket class and one or more of the losing participants may be moved to a lower bracket class. Through repeated play each participant moves into a class suitable to the skill of the participant.

4 Claims, 5 Drawing Figures

SCHEDULING BOARD AND METHOD OF USE THEREOF

BRIEF DESCRIPTION OF THE INVENTION

Field of the Invention

This invention relates to method and apparatus for organizing challenge play in competitive events and particularly to apparatus used for the purpose and to the methods of using such apparatus.

Prior Art

There has long been a need for a universal method of classifying the capability of sports participants in competitive sports so that the participants can be readily matched to compete against others of compatible skills. It is also desirable that the participants be able to advance in classification in the event their skills sufficiently increase, and similarly, if their skills decline it may be desirable to reduce the classification level of the participant so that he can still easily determine which other participants can provide a comparable level of competition.

In the past, some types of competitive sports have had systems that will allow participants to readily find competitors of substantially the same skill and ability level. The individual average system used in bowling, for example, or the handicap system commonly used in golf allow competitors to determine whether or not they are actually more or less equally skilled and, with the use of handicaps may allow participants of somewhat unequal skill and ability to enjoy competition against one another. Many other competitive sports, however, do not have such a classification system. Whether the participants are individuals or teams, it has not always been possible, in the past, to assign them a classification that will allow for easy assignment in competition to a truly competitive level of play. This is particularly true in the case of sporting events wherein a ball is moved between players, such as tennis, handball and badmitton, but it also is true of other sports such as baseball, softball, football, swimming, archery, pool, gliding, parachuting, track, arm wrestling and marbles, to mention just a few.

While various systems have been proposed to accurately arrive at a participant's proper skill classification level with regard to some sports, I am not aware of any system known in the past that can be widely applied. In tennis, for example it has been proposed that players be rated on the basis of answers they submit to a questionaire or based on a physical, non-competitive test that is given. While these systems do provide for some form of classification and may be helpful, they are not based on actual competitive situations and do not allow for easy determination of those players who may be classified too high or are ready to be advanced.

Additional objects and features of the invention will become apparent from the following detailed description, taken together with the accompanying drawing.

THE DRAWING

In the drawing:

FIG. 1 is a front elevation view of the scheduling board of the invention, with participant tags arranged thereon in a preferred pattern to indicate an initial round of participation;

FIG. 2, a side elevation view;

FIG. 3, a view like that of FIG. 1, but showing the participant tags arranged in a preferred pattern to indicate a second round of participation and with the preferred pattern of rotation of participant tags shown by arrows;

FIG. 4, a view like FIG. 1, but showing the participant tags arranged in another pattern for an initial round of competition and with arrows showing the pattern of rotation of participant tags; and FIG. 5, a view like FIG. 4, but showing still another arrangement of participant tags for an initial round of competition.

DETAILED DESCRIPTION

Figure 1:
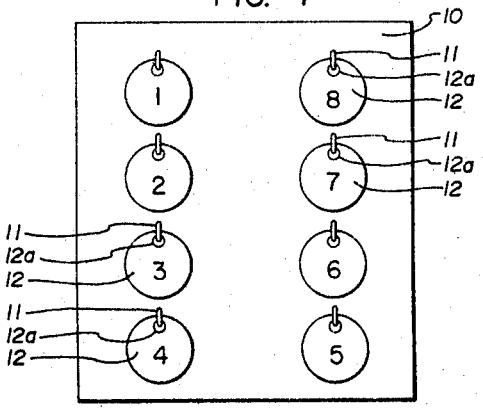
Figure 2:
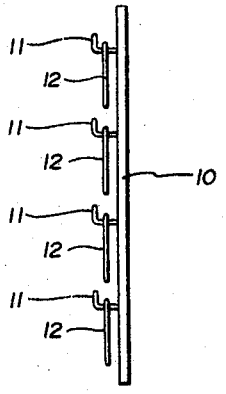
Figure 3:
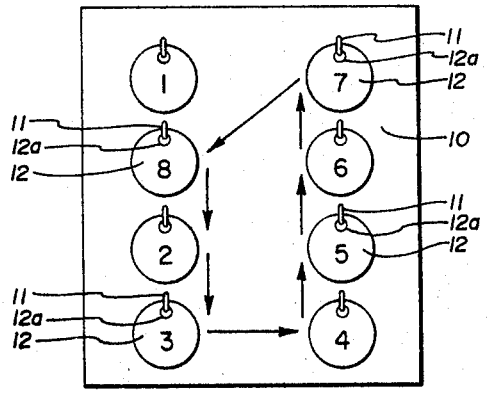

Referring now to the drawing:

In the illustrated preferred embodiment, as shown in FIGS. 1–3, the scheduling board of the invention includes a board 10, having attachment means in the form of hooks 11 projecting from the board. The hooks are arranged in rows and such that each hook in a row is paired with a hook in the other row.

Participant tags 12, which may be of any desired configuration, but which are shown as round discs, each have a hole 12*a* through an upper portion thereof, by which the tags can be hung on the hooks 11.

Each participant tag has individualized identification data thereon. Such individualized identification data can take various forms, such as a color, a particular configuration, a participant name or title, but, as shown, comprises a number that is assigned to and that then designates a particular participant.

In using the scheduling board, the participant tags are hung on the attachment means such that each participant tag in one row is paired with another participant tag in the other row. Preferably, the participant tags, with numerical individualized identification data thereon, are arranged for an initial round of competition as shown in FIG. 1, with the lowest numbered tag at one end of a first row and with the tags arranged in numerical sequence in that row and in a reverse direction in the other row. So arranged, the participants represented by the pairs of tags (one in each row) are scheduled for a round of competition. After the competition has occurred or a time for completing the round of competition has been completed the tags are rotated to establish competitors for a new round of play.

While the initial tag arrangement of FIG. 1 is preferred, it will be apparent that virtually any initial sequence can be used, so long as the paired relationship of the two rows is maintained. For example, the numberical sequences shown in FIG. 4 or FIG. 5 can be used.

Figure 4:
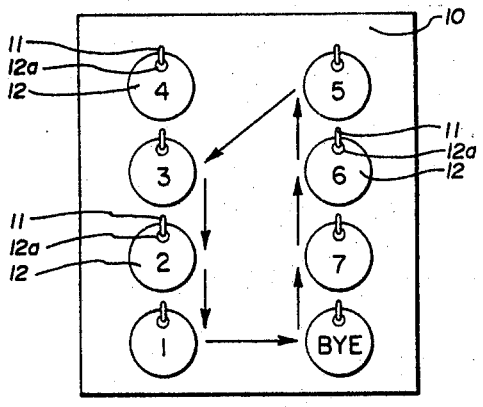
Figure 5:
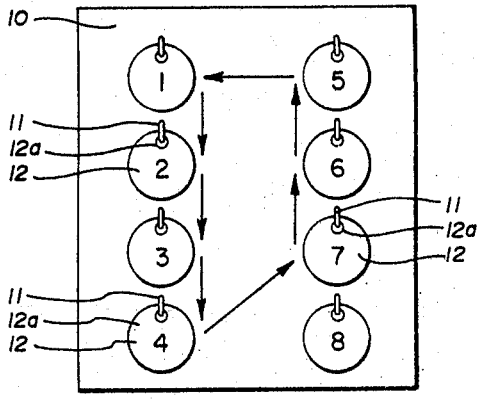

As shown in FIG. 4, it is also possible to accommodate an uneven number of participants by designating one tag, here shown at 13, to indicate a bye. During use of the board the participant represented by the tag paired with the tag designated as the "bye" tag during any round will not have an opponent.

Regardless of the initial arrangement of the tags, in accordance with the method of the present invention tags are rotated in a particular pattern to insure orderly competition between each pair of participants. Thus, as shown by the arrows in FIGS. 3–5, one tag, at one end of a first row is never moved. The tag at the other end of that row is rotated by moving it from its attachment means onto the paired attachment means of the other row and each of the other tags in the first row is advanced one attachment means further away from the one tag that is never moved. The tag paired with the tag that is never moved (at one end of the second row) is moved to the attachment means in the first row next to the tag that is never moved. Each other tag in the second row is then moved one attachment means towards being paired with the tag that is never moved.

After each rotation of the tags a new set of paired tags is provided and the participants identified by such paired tags are scheduled to compete. When the tags have been rotated a number of times equal to the total number of participants, minus one, when the number is even, or equal to the total number, when the number is odd, each participant will have been scheduled to play each other participant.

The scheduling board and method of use herein described is particularly useful in allowing consistent winners in the competition to be determined and to advance to similarly compete against others having better skills. In the same manner consistent losers can be readily identified to be placed in similar competition with others of comparable skill. At the same time, as skills are improved, the method allows for ready identification since the participant will become a consistent winner and can readily be recognized as properly ready to play with more skilled persons.

Although preferred forms of my invention have been herein disclosed, the present disclosure is made by way of example and variations are possible without departing from the subject matter coming within the scope of the following claims, which subject matter I regard as my invention.

I claim:

1. Apparatus for scheduling competitive events comprising a backing member;

participant identification means arranged in paired first and second rows on the backing member and means allowing rotating of the participant identification means such that the relative position of one fixed participant identification means at one end of the first row does not change while the participant identification means at the other end of the first row moves to the corresponding other end of the second row, the participant identification means at the one end of the second row is moved to the first row next to the fixed participant identification means, each other participant identification means in the first row is moved to the position of the next adjacent participant identification means in the direction of the other end of the row and each other participant identification means in the second row is moved to the position of the next adjacent participant means in the direction of the one end of the other row.

2. Apparatus for scheduling competitive events as in claim 1, wherein the backing member is a board having first and second rows of attachment means thereon and with attachment means of the rows in paired relationship; and the participant identification means comprises tags adapted to be releasably mounted to the attachment means.

3. Apparatus as in claim 2, wherein the participant identification means comprises tags, each having a hole therethrough and a number thereon, the number on each tag being different than the number on each other tag; and the attachment means comprises hooks projecting from the board and adapted to project through the holes of the tags.

4. A method of scheduling competitive events comprising placing participant identification means in two rows, with each participant identification means then representing a participant in the event and with each identification means in a first of the two rows being in paired relationship with an identification means in the second of the two rows, whereby participants represented by each of the identification means in a pair know that they are to compete in a round of the competitive event;

holding the identification means at one end of the first row relatively fixed while sequentially rotating the identification means in a pattern such that the identification tag paired with the fixed tag is moved from one end of the second row to the position next to the fixed identification means in the first row, the identification means at the other end of the first row is moved to the other end of the second row, all other identification means in the first row are moved one position towards the other end and all other identification means in the second row are moved towards the one end of the second row, until each identification means has been paired with each other identification means.

* * * * *